US005590818A

United States Patent [19]

Raba et al.

[11] Patent Number: 5,590,818

[45] Date of Patent: Jan. 7, 1997

[54] MULITSEGMENTED NOZZLE FOR DISPENSING VISCOUS MATERIALS

[75] Inventors: Charles E. Raba, Westfield; Joseph A. Gabriele, Whippany, both of N.J.

[73] Assignee: SmithKline Beecham Corporation, Philadelphia, Pa.

[21] Appl. No.: 446,387

[22] Filed: May 22, 1995

Related U.S. Application Data

[63] Continuation of Ser. No. 350,930, Dec. 7, 1994.

[51] Int. Cl.[6] ..... B65D 5/72

[52] U.S. Cl. ..... 222/575; 239/601; 141/99

[58] Field of Search ..... 222/94, 575; 239/601, 239/549, 423, 422; 141/9, 99, 100

[56] References Cited

U.S. PATENT DOCUMENTS 4,525,175 6/1985 Stellaccio ..... 239/422 X 4,896,796 1/1990 Harris ..... 222/94 X 5,102,016 4/1992 Ball et al. ..... 239/549 X

*Primary Examiner*—Gregory L. Huson

*Attorney, Agent, or Firm*—Nora Stein-Fernandez; William T. King; Edward T. Lentz

[57] ABSTRACT

This invention relates to a novel, multisegmented nozzle for dispensing viscous materials, particularly for dispensing differently colored toothpaste into toothpaste tubes so as to produce toothpaste of striped appearance when dispensed from the tube. The nozzle has a tubular body defined by an outer body wall, and has within the tubular body a central channel and a plurality of longitudinal first and second side channels situated around the central channel. The first side channels have a cross section which narrows towards the central channel; the second side channels have a rectangular cross section. Because of this configuration the nozzle is able to load multicolored toothpaste tubes which dispense toothpaste in a substantially more uniform striped pattern than conventionally loaded multicolored toothpaste tubes.

12 Claims, 3 Drawing Sheets

MULITSEGMENTED NOZZLE FOR DISPENSING VISCOUS MATERIALS

Figure 1:
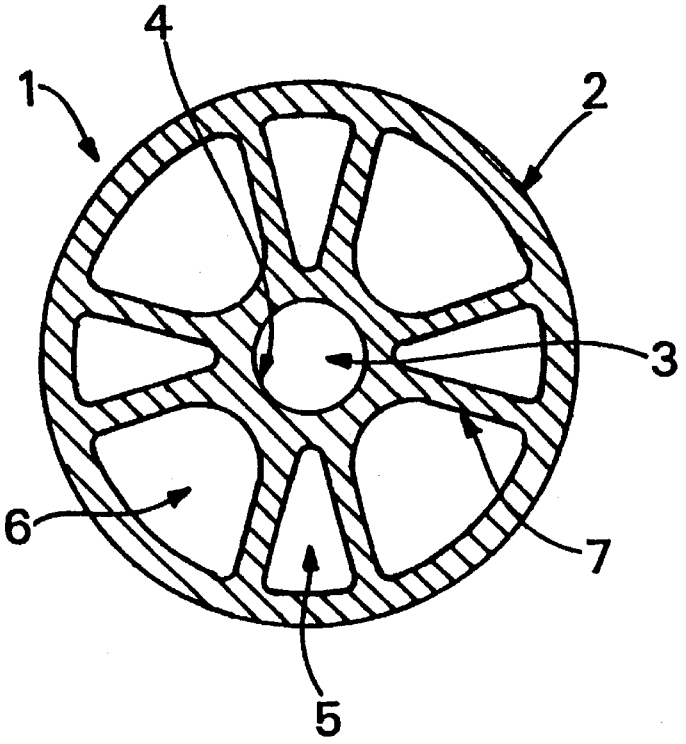
Fig. 1 PRIOR ART

This is a continuation of application Ser. No. 08/350,930, filed Dec. 7, 1994.

This invention relates to a novel nozzle for use in the filling of containers with viscous flowable materials, in particular to nozzles for the filling of toothpaste containers with toothpaste in adjacent segments of differently coloured toothpaste material so as to produce toothpaste of a striped appearance on dispensing. The invention also relates to an apparatus for filling a container with toothpaste using such a nozzle, and to a toothpaste container when filled using such a nozzle.

Apparatus for filling toothpaste into containers such as collapsible tubes and pumps is known. A particular known form of such apparatus is intended for filling a toothpaste which comprises a plurality of differently constituted toothpaste materials, especially differently coloured toothpaste materials, into a container such that the differently constituted materials are disposed within the container in adjacent segments. When the toothpaste is dispensed from such a container the toothpaste has a striped appearance. Such differently coloured toothpaste materials are known, for example those which are used to make up three-coloured striped toothpastes such as that marketed under the name "Aquafresh" (Trade Mark), having a white base material and red blue or green stripes comprising respectively red and blue or green coloured toothpaste materials.

Generally such apparatus includes a nozzle through which the toothpaste is introduced into the container, which generally comprises a tubular, usually cylindrical, body, within which there is a central longitudinal channel, usually having a cylindrical bore, and a plurality of side channels surrounding the central channel. The side channels normally have a cross section, perpendicular to the longitudinal axis of the body, which narrows towards the centre of the body. For example the side channels may be formed between walls extending radially from the central channel, defining segments of generally wedge shaped cross section.

According to this invention a nozzle suitable for filling a flowable viscous material into a container is provided, comprising a tubular body defined by an outer body wall, within the body there being a plurality of longitudinal channels for the longitudinal flow of the viscous flowable materials along and within the nozzle, the longitudinal channels comprising:

a central channel, bounded by a central channel wall, one or more first side channels, situated between the central channel wall and the outer body wall, and bounded between side channel walls, the first side channels having a cross section perpendicular to the longitudinal axis of the tubular body which narrows in the direction from the outer body wall towards the central channel, and, one or more second side channels, situated between the central channel wall and the outer body wall, and bounded between side channel walls, the second side channels having a cross section perpendicular to the longitudinal axis of the tubular body which does not narrow in the direction from the outer body wall towards the central channel, all of the longitudinal channels being open at an outlet end of the nozzle.

The nozzle of the invention is suitable for filling toothpaste materials into a toothpaste container such as a conventional tube or pump, differently constituted toothpaste materials being passed down a respective central channel or first or second side channels, so as to deposit the toothpaste materials in the container in adjacent segments, such that on dispensing the toothpaste from the container, for example by collapsing the tube or operating the pump in a conventional manner to force the toothpaste out in the form of a thread through a nozzle, the toothpaste is dispensed with the segments still adjacent. Suitably the differently constituted materials may be differently coloured materials, such that the thread of dispensed toothpaste has a striped appearance.

The tubular body is suitably a cylindrical tubular body, of diameter appropriate to the container which is to be filled with the material, and suitable dimensions will be well known to those skilled in the an of filling such containers. The tubular body may taper or be suitably otherwise profiled at the outlet end as in conventional nozzles of this type.

The central channel may suitably comprise a central cylindrical channel, concentric and coaxial with a cylindrical tubular body, and suitably bounded by a channel wall which has a cylindrical bore, concentric and coaxial with the tubular body.

The number of first side channels will be determined inter alia by the number of segments which it is desired to form in the container, which in turn may be determined by the number of differently constituted materials in use. Suitably there may be four first side channels, symmetrically disposed within the tubular body. The first side channels may suitably be bounded at their outer side by the outer body wall, and at their inner side by the outer surface of the central channel wall. The narrowing sectional shape of the first side channels may be achieved by their also being bounded by side channel walls which converge toward the centre of the tubular body, for example in a cylindrical tubular body by two converging side channel walls being general parallel to diameters of the body.

The number of second side channels will also be determined inter alia by the number of segments which it is desired to form in the container, which in turn may be determined by the number of differently constituted materials in use. Suitably there may be four second side channels, symmetrically disposed within the tubular body. The second side channels may suitably be bounded at their outer side by the outer body wall, and at their inner side by the outer surface of the central channel wall. The non narrowing sectional shape of the first side channels may be achieved by their also being bounded by side channel walls which do not converge toward the centre of the tubular body, for example in a cylindrical tubular body by two side channel walls being generally parallel to diameters of the body. In a preferred embodiment these non-converging walls are generally parallel to each other, so that the second side channels are overall of a generally rectangular cross section, albeit possibly with an inner and/or outer walls which respectively follow the curve of a cylindrical inner channel wall and/or outer body wall.

In a particularly preferred embodiment of the nozzle of this invention, the central channel and one or more of the first side channels are in communication with each other at the outlet end of the nozzle by means of an opening in the central channel wall in the region where the central channel wall separates the central channel and the first side channel(s). Preferably all of the first side channels are in communication with the central channel in this manner. The opening(s) may be in the form of a slot open at the outlet end of the nozzle and extending longitudinally away from the outlet end of the nozzle and which may be substantially rectangular in shape, with the long sides of the rectangle aligned substantially parallel to the longitudinal axis of the nozzle. Optionally such a cut out may be rounded at the end remote from the outlet end.

The invention also provides a process for the use of a nozzle as described herein for filling a toothpaste into a container, suitably a toothpaste material comprising two or more differently constituted, e.g. differently coloured, toothpaste materials. In such use the respective differently coloured toothpaste materials may be caused to flow along respectively the central or first or second side channels. Suitably a first toothpaste material may be caused to flow along both the central and first side channels, and one or more second toothpaste materials may be caused to flow along respective second side channels. Suitably a white first toothpaste material may be caused to flow along the central and first side channels, and one or more coloured second toothpaste material may be caused to flow along respectively one or more of the second side channels, to deposit the toothpaste in the container in the form of coloured segments of second toothpaste material separated by segments of white first toothpaste material with a central core of first white toothpaste material.

The nozzle of the invention may comprise part of an apparatus for filling toothpaste into a container, and the invention therefore also provides an apparatus for filling toothpaste into a container, which incorporates such a nozzle. Apparatus for filling toothpaste into containers is known, such as the filling machines produced by IWK Packaging Machinery Inc. Fairfield N.J, U.S.A., and Norden Packaging Company. The part of the nozzle remote from the outlet end of the nozzle may be constructed in a manner well known to those skilled in the an so as to mate with such a known filling machine.

Known apparatus for filling a toothpaste which comprises two or more differently coloured toothpaste materials into a container such that the materials are disposed in adjacent segments within the container, as described above, normally produces segments which taper toward the centre of the container. This means that as viewed from the outside of a transparent or translucent container, such as the toothpaste pumps commonly in use, the edges of the segments are thinner than the centre of the segments, and hence their colour is non uniform, being darker at the centre than at the edges. Using the nozzle of the invention, when coloured toothpaste materials are caused to flow along the second side channels the segments formed do not taper toward the centre, and their appearance as seen from the outside of a transparent or translucent container is advantageously substantially more uniform.

Therefore in a further aspect of this invention, a tubular toothpaste container such as a collapsible tube or pump is provided, containing a plurality of differently constituted, e.g. differently coloured, toothpaste materials, in which a first toothpaste material is disposed within the container in the form of a central core of toothpaste material, and one or more second toothpaste materials are disposed in the container in the form of segments arranged around the central core, with an outer surface of the segments of second toothpaste material in contact with the container wall, with an inner surface of the segments of second toothpaste material adjacent to the core, and wherein the cross section of the segments does not converge toward the centre of the container.

Disposed between the segments of the second toothpaste materials there may be segments of first toothpaste material, which may be integral with the core. Suitably there may be four segments of second toothpaste material. Suitably the first toothpaste material may be a white toothpaste material, and one or more of the segments of the second toothpaste material may be red, and one or more of the segments of the second toothpaste material may be blue or green. Suitably the segments of second toothpaste material may have substantially parallel non-converging surfaces extending inwardly from the outer surface of the segments, preferably the segments of the second toothpaste material being substantially rectangular in cross section.

A further advantage of the preferred embodiment in which the central channel and one or more of the first side channels are in communication with each other at the outlet end of the nozzle by means of an opening in the central channel wall in the region where the central channel wall separates the central channel and the first side channel(s) as described above, is that the segments formed in the container are found to be particularly cleanly edged.

This feature is not at present found in known nozzles for filling toothpaste into containers, and therefore in a further aspect the present invention provides a nozzle through which a toothpaste may be introduced into a container, which comprises a tubular, for example cylindrical, body, within which there is a central longitudinal channel, for example having a cylindrical bore, and a plurality of longitudinal side channels, defined between side channel walls, surrounding the central channel, all of the longitudinal channels terminating open at an outlet end of the nozzle, the central channel and one or more of the side channels being in communication with each other at the outlet end of the nozzle by means of an opening in the central channel wall in the region where the central channel wall separates the central channel and the side channel(s).

The form of the opening may be substantially as described above.

The nozzle of the present invention may suitably be made of metals such as those used conventionally to make nozzles for filling toothpaste containers, e.g. stainless steel. The dimensions of the nozzle may be generally the same as those of conventional nozzles of this type.

The invention will now be described by way of non-limiting example only, with reference to the accompanying drawings.

FIG. 1. Shows a cross section through a known nozzle for filing toothpaste into a toothpaste container.

Figure 2:
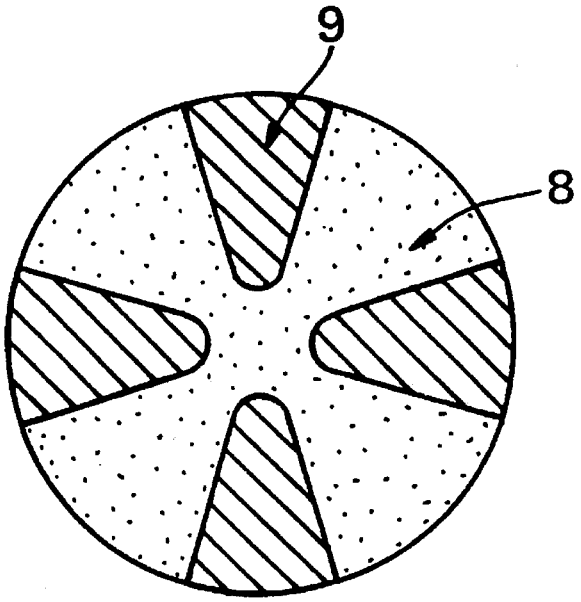
Fig. 2 PRIOR ART

FIG. 2. Shows a cross section through the toothpaste in a toothpaste container as produced by filling the container using the nozzle of FIG. 1.

Figure 3:
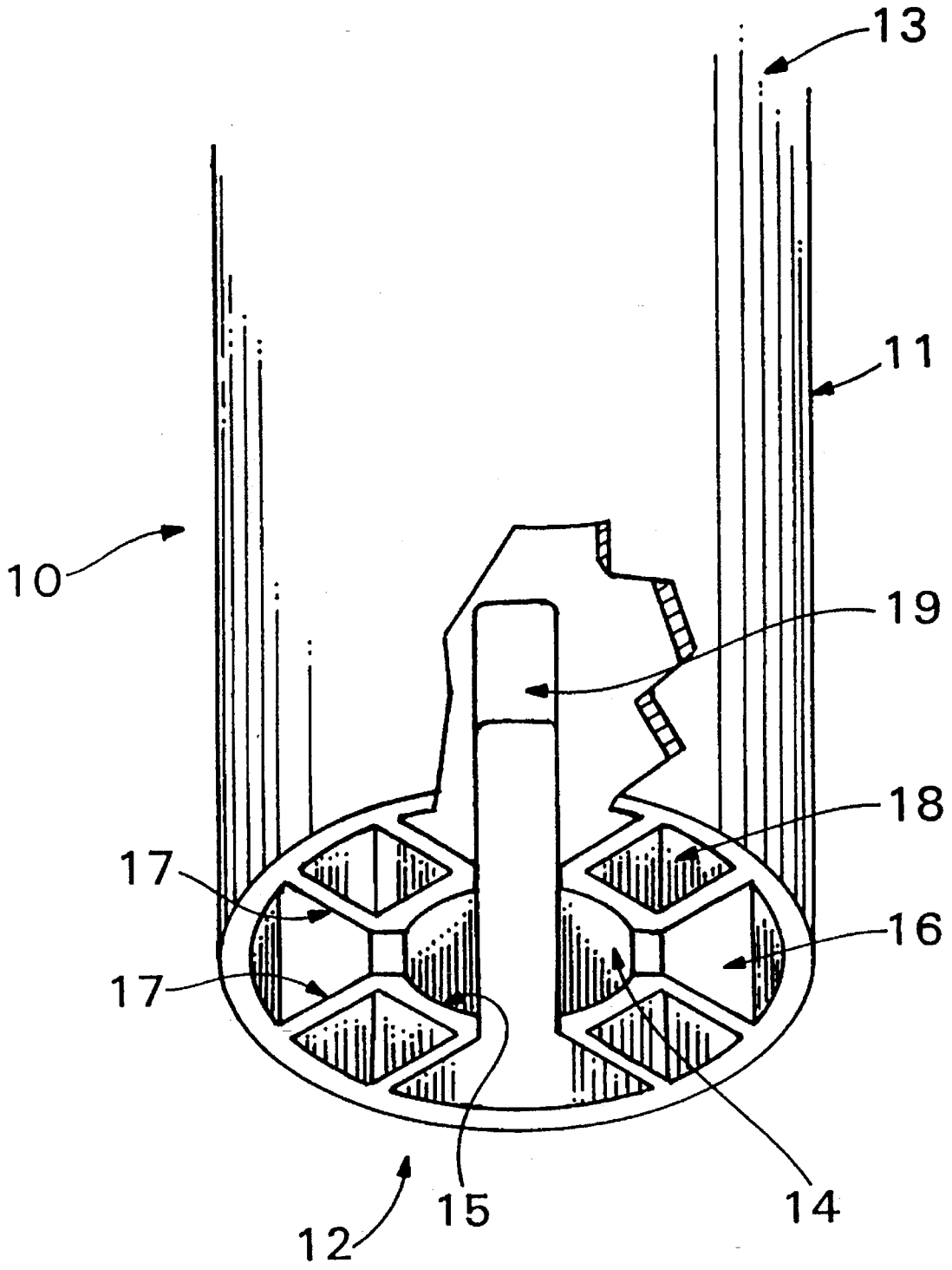

FIG. 3. Shows a perspective, part cutaway, view of a nozzle of this invention.

Figure 4:
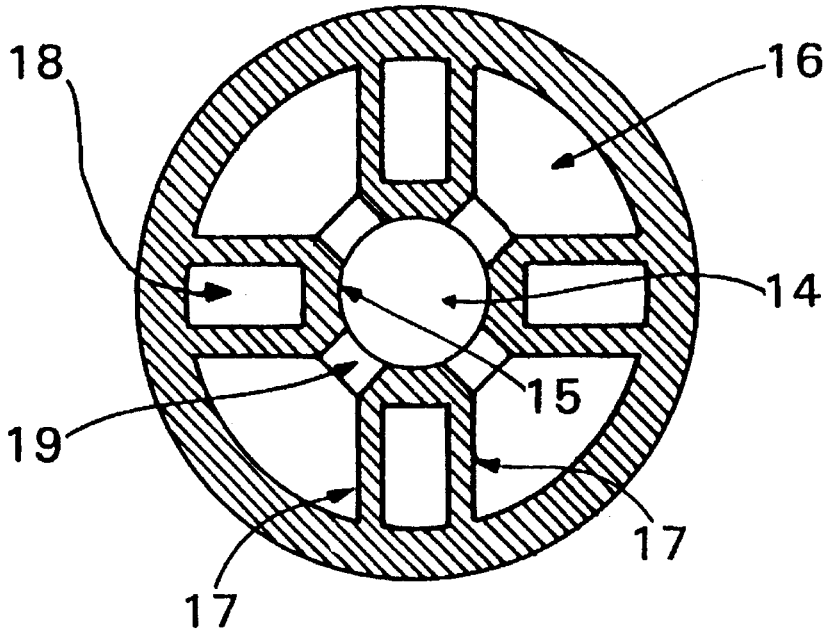

FIG. 4. Shows a cross sectional view through the nozzle of FIG. 3 taken immediately upstream of the outlet end.

Figure 5:
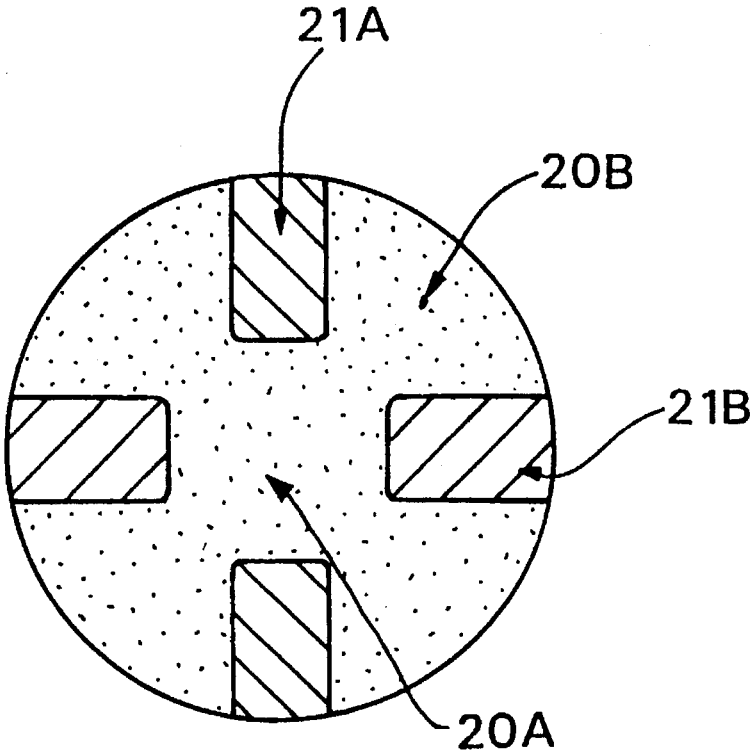

FIG. 5. Shows a cross section through the toothpaste in a toothpaste container as produced by filling the container using the nozzle of FIGS. 3 and 4.

Referring to FIG. 1, a known nozzle (1) generally comprises an outer cylindrical tubular body wall (2). Within the nozzle (1) is an axial central channel (3) bounded by a central channel wall (4). Disposed around the central channel (3) are a number of first side channels (5) and second side channels (6) bounded by side channel walls (7) which converge towards the central axis of the nozzle (1). All of the side channels (5, 6) have a cross section taken perpendicular to the longitudinal axis of the nozzle (1) which narrows toward the centre of the nozzle (1), being the axis of the cylinder, i.e. being generally wedge-shaped as viewed in cross section.

To fill a toothpaste container (not shown) the outlet end of the nozzle (1) is inserted into an empty cylindrical toothpaste container of an internal diameter slightly larger than that of the body wall (2), and toothpaste is caused to flow using known apparatus along the nozzle through the channels (3, 5, 6) and out of the outlet end into the container. A first toothpaste material (8) is caused to flow along the central channel (3) and the second side channels (5), and a second toothpaste material (9) which is differently coloured from the first toothpaste material (8) is caused to flow along the second side channels (5). The cross sectional appearance of the toothpaste formed within the container is as shown in FIG. 2, the segments of toothpaste material (8, 9) narrowing in a wedge shape toward the central axis.

Referring to FIGS. 3 and 4, a nozzle (10) of the invention is shown, comprising an outer cylindrical tubular body wall (11), the nozzle terminating at the outlet end (12). The part (13) of the nozzle (10) remote from the outlet end (12) is conventionally adapted to mate with a conventional machine for filling toothpaste containers.

Internally the nozzle (10) has a central channel (14) bounded by a central channel wall (15). The nozzle also has four first side channels (16), symmetrically disposed around the central channel (14), the first side channels (16) being situated between the outer body wall (11) and the central channel wall (15). The first side channels are bounded by side channel walls (17) which relative to the first side channels (16) converge toward the centre of the nozzle (10) such that the cross-sectional shape of the first side channels narrows toward the central axis of the nozzle (10), being essentially wedge-shaped in cross section.

The nozzle also has four second side channels (18), symmetrically disposed around the central channel (14), the second side channels (18) also being situated between the outer body wall (11) and the central channel wall (15). The second side channels (18) are bounded by side channel walls (17) which relative to the second side channels (18) are substantially parallel sided, such that the cross-sectional shape of the second side channels (18) is essentially rectangular in cross section.

The central channel (14) and all of the first side channels (16) are in communication with each other at the outlet end (12) of the nozzle (10) by means of an opening (19) in the central channel wall (15) in the region where the central channel wall (15) separates the central channel (14) and the first side channels (16). This opening (19) is in the form of a substantially rectangular slot, open at the outlet end (12) of the nozzle (10) and extending longitudinally upstream from the outlet end (12).

The nozzle of FIGS. 3 and 4 maybe used to fill a toothpaste container (not shown) with toothpaste in a manner analogous to that used with the known nozzle of FIG. 1 described above. A first toothpaste material (20) may be caused to flow along the central channel (14) and the first side channels (16), and one or more second toothpaste materials (21) may be caused to flow along the second side channels (18). When used in this way, the cross sectional appearance of the segments of first and second toothpaste material (20, 21) formed in the container when it is filled is shown in FIG. 5. The first toothpaste material (20) is disposed within the container in the form of a central core (20A) and surrounding segments (20B), with the segments of second toothpaste material (21), being of substantially rectangular section, and alternating with segments of the first toothpaste material (20B). Two opposing segments (21A) of second toothpaste material (21) may be of a red toothpaste material, and the remaining two segments (21B) may be a blue or green toothpaste material so that as the toothpaste material (20, 21) is dispensed from a container such as a collapsible tube or pump in the form of a thin stream the dispensed toothpaste has a longitudinally striped appearance.

It will apparent from FIG. 5 that if the container has transparent or translucent walls, when viewed from the outside the thickness of the segments (21) will be substantially uniform across the width of the segment, whereas in the toothpaste illustrated in FIG. 2, the thickness of the segments (9) will be less at the edges than at the centre. The observed colour density of the segments (21) will therefore be substantially more uniform.

We claim:

1. A nozzle suitable for filling a flowable viscous material into a container, comprising a tubular body defined by an outer body wall, within the body there being a plurality of longitudinal channels for the longitudinal flow of the viscous flowable materials along with the nozzle, the longitudinal channels comprising:

a central channel, bounded by a central channel wall, one or more first side channels, situated between the central channel wall and the outer wall, the first side channels having a cross section perpendicular to the longitudinal axis of the tubular body which narrows in the direction from the outer body wall towards the central channel, and, one or more second side channels, situated between the central channel wall and the outer body wall, the second side channels having a cross section perpendicular to the longitudinal axis of the tubular body which does not narrow in the direction from the outer body wall towards the central channel, all of the longitudinal channels being open at an outlet end of the nozzle.

2. A nozzle according to claim 1, wherein the tubular body is a cylindrical tubular body, of diameter appropriate to the container which is to be filled with the material.

3. A nozzle according to claim 2 wherein the central channel comprises a central cylindrical channel, concentric and coaxial with a cylindrical tubular body, and bounded by a channel wall which has a cylindrical bore, concentric and coaxial with the outer body wall.

4. A nozzle according to claim 3 having four first side channels, symmetrically disposed within the tubular body, bounded at their outer side by the outer body wall, and at their inner side by the outer surface of the central channel wall.

5. A nozzle according to claim 4 having four second side channels, symmetrically disposed within the tubular body, bounded at their outer side by the outer body wall, and at their inner side by the outer surface of the central channel wall.

6. A nozzle according to claim 5 wherein the non narrowing sectional shape of the first side channels is achieved by their being bounded by side channel walls which do not converge toward the centre of the tubular body.

7. A nozzle according to claim 6 having a cylindrical tubular body, and in which the second side channels are bounded by two side channel walls being generally parallel to diameters of the body.

8. A nozzle according to claim 7 wherein the second side channels are overall of a generally rectangular cross section, optionally with an inner and/or outer walls which respectively follow the curve of a cylindrical inner channel wall and/or outer body wall.

9. A nozzle according to claim 8 wherein the central channel and one or more of the first side channels are in communication with each other at the outlet end of the nozzle by means of an opening in the central channel wall in the region where the central channel wall separates the central channel and the first side channel(s).

10. A nozzle according to claim 9 wherein all of the first side channels are in communication with the central channel.

11. A nozzle according to claim 9 or 10 wherein the opening(s) are in the form of a slot open at the outlet end of the nozzle and extending longitudinally away from the outlet end of the nozzle.

12. A nozzle according to claim 11 wherein the slot is substantially rectangular in shape, with the long sides of the rectangle aligned substantially parallel to the longitudinal axis of the nozzle.

* * * * *